United States Patent [19]

Rowen et al.

[11] Patent Number: 4,551,028

[45] Date of Patent: Nov. 5, 1985

[54] DISPOSABLE ELECTRONIC WATCH

[76] Inventors: John B. Rowen, 20 Summer St., #2, Northboro, Mass. 01532; Christopher M. Rowen, 91 Mechanic St., Marlboro, Mass. 01752; Charles Janusis, 20 Summer St., #2, Marlboro, Mass. 01532

[21] Appl. No.: 563,048

[22] Filed: Dec. 19, 1983

[51] Int. Cl.[4] ..... G04B 1/00; G04B 37/00

[52] U.S. Cl. ..... 368/204; 368/276

[58] Field of Search ..... 368/88, 203–204, 368/276

[56] References Cited

U.S. PATENT DOCUMENTS 4,223,521 9/1980 Saitoh et al. ..... 368/204

4,251,604 2/1981 Umemoto ..... 368/204 X

*Primary Examiner*—Vit W. Miska

*Attorney, Agent, or Firm*—John P. McGonagle

[57] ABSTRACT

An electronic watch of relatively few parts and consequent inexpensive construction employing a liquid crystal display (LCD), an integrated circuit chip and a watch battery. The watch is electrically dormant until activated by means of a pull tab. Adjustments are made through holes in the watch case.

7 Claims, 5 Drawing Figures

DISPOSABLE ELECTRONIC WATCH

BACKGROUND OF THE INVENTION

This invention relates to an electronic watch of relatively few parts and consequent inexpensive construction which incorporates a liquid crystal display (LCD), an integrated electronic circuit chip and a watch battery activated by means of a pull tab.

Electronic watches have achieved widespread consumer acceptance in the marketplace. With advances in polymer chemistry, micro-electronics and production techniques, it is possible now to offer a watch which may be produced and offered at the low price of a disposable item.

To be practical, a disposable electronic watch must be functional, have an indefinite storable shelf life (particularly prior to purchase by the consumer), have a means for adjusting time, be easily manufactured, and in particular be available at very low cost.

A present drawback to an inexpensive, disposable electronic watch is the many discrete, internal components of present watch assemblies necessitating numerous and involved manufacturing operations which increase production costs. Since most electronic watches have a battery installed during the manufacturing operation, another drawback is the lack of means for preventing electrical activation of the battery within the watch prior to sale to the consumer. Electrical activation of the battery at the time of manufacturing means a drain on the battery before actual sale to the consumer and a consequent limited shelf life of the watch and a limited life of the watch while in the consumer's hands unless the battery is replaced.

SUMMARY OF THE INVENTION

This invention relates to an electronic watch employing a sealed construction in which is included a battery. The watch is electrically dormant until activated by means of a pull tab which, during the manufacturing process, has been inserted between the battery and the electronic circuitry.

Accordingly, it is an object of this invention to provide an electronic watch employing a sealed construction in which is included a liquid crystal display (LCD), an integrated circuit chip, and a battery. It is another object of this invention to provide an electronic watch with relatively few parts so that the manufacturing steps used to assemble the watch are less complex and less expensive.

It is another object of this invention to provide an electronic watch with the means for blocking activation of the watch battery prior to sale to the consumer.

DETAILED DESCRIPTION

Figure 1:
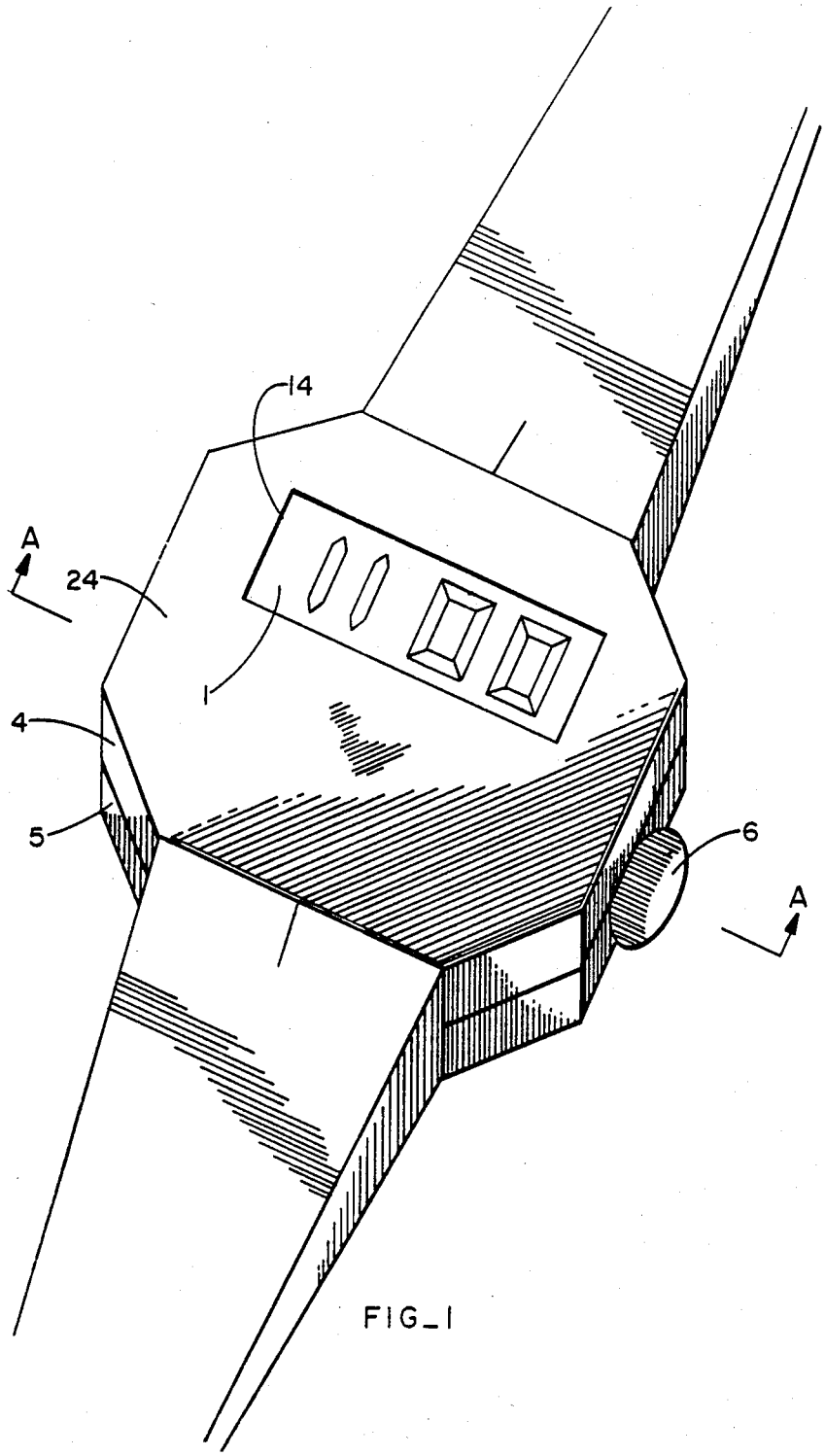
FIG. 1 is a perspective view of a disposable electronic watch according to the present invention.

The disposable electronic watch in FIG. 1 has visible from the outside a casing with a plurality of sides and an upper case section 4 and a lower case section 5, a liquid crystal display (LCD) 1, and a pull tab 6. In other embodiments of the invention the casing may be round and light emmitting diodes (LED) may be used in place of the LCD.

The upper case section 4 has an opening 14 on its face 24 defined by the LCD 1 internally mounted within the casing. Viewed cross-sectionally in FIG. 3 and FIG. 4 it can be seen that the upper case section 4 forms a cavity 15 which encapsulates various elements of the watch. The upper case section 4 has a groove 23 on its internal side toward its outer edge. This groove 23 is mirrored by a groove 25 in the lower case section 5. The grooves 23 and 25 form a channel for glueing the upper case section 4 to the lower case section 5. As can be seen from FIG. 5 the grooves 23 and 25 are defined by the sides of the casing except for the side through which the pull tab 6 protrudes. The grooves 23 and 25 are located nearly at the perimeter of the casing.

Figure 4:
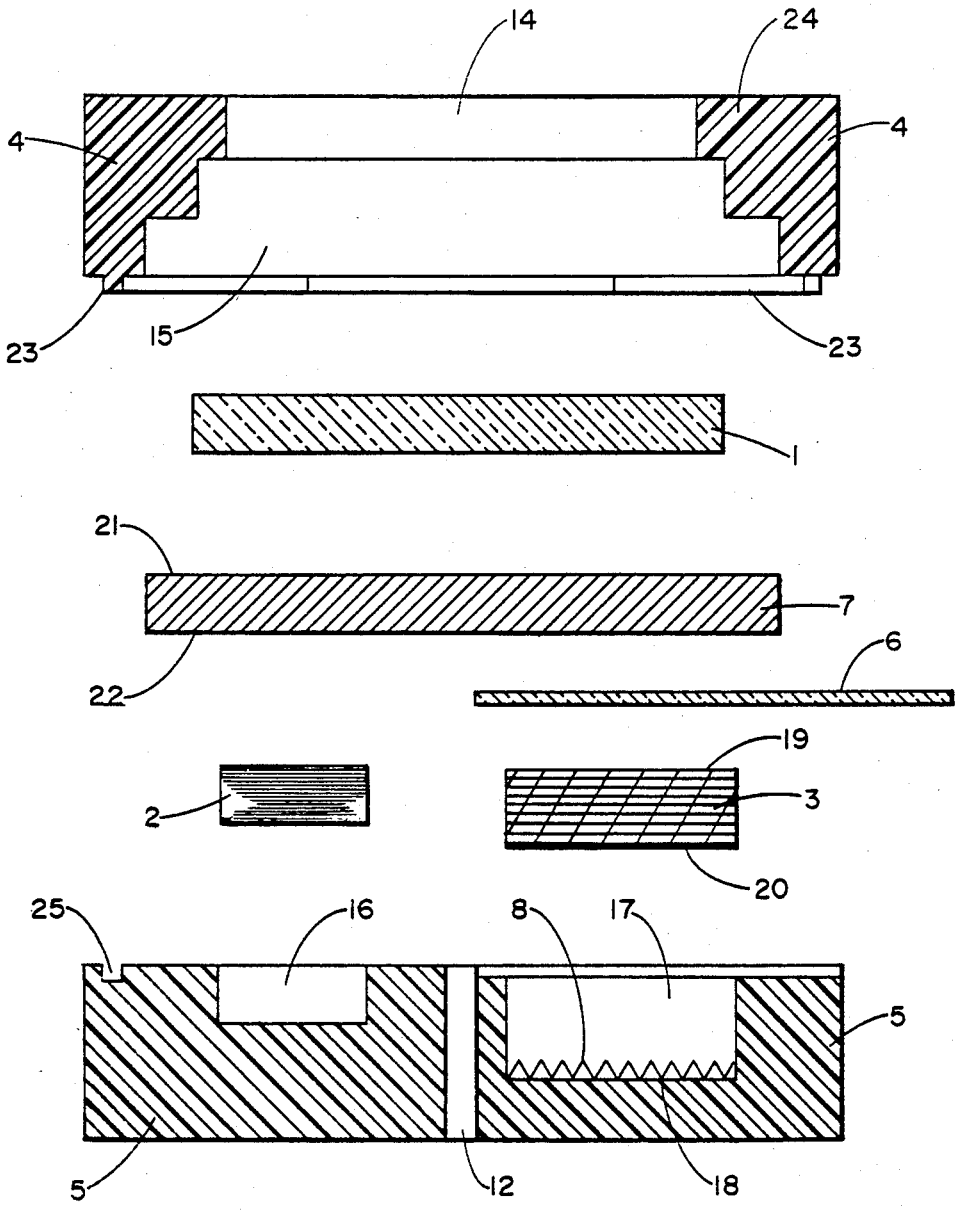
FIG. 4 is an exploded cross section view of FIG. 3.

The lower case section 5, shown cross-sectionally in FIG. 4 along the line A—A of FIG. 1, contains a shallow cavity 16 into which an electronic circuit chip 2 is fitted, and a narrow hole 12 through which watch adjustments may be made.

Figure 3:
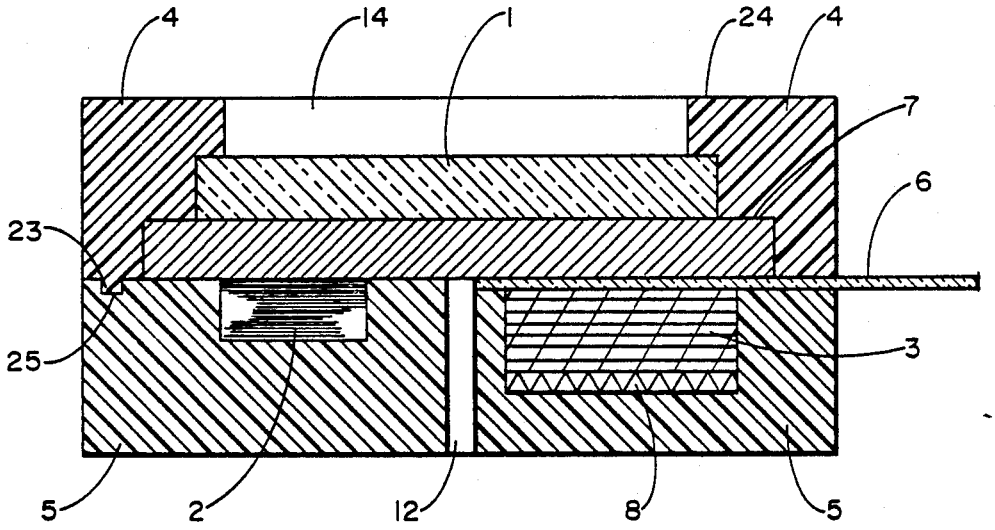
FIG. 3 is a cross section view taken on line A—A of FIG. 1

Viewed cross-sectionally in FIG. 3 it can be seen that the watch includes an electronic circuit chip 2 which has integrated onto it oscillator, counter, decoder and display driver electronic circuits. The operation of the integrated circuitry is well understood in the art. The oscillator continuously generates oscillations at a fixed frequency. These oscillations drive the counter circuits which produce successive counts. The counts in turn are decoded by a docoder which produces different combinations of outputs. Each such output represents a binary digit. The outputs are fed into display driver circuits which in turn activate the LCD 1.

The operation of the LCD 1 is also well understood in the art. The LCD 1 has a number of conducting segments. In response to a particular decoder output the display driver circuits apply a voltage to one or more of the conducting segments of the LCD 1 In response to a voltage applied to a conducting segment, the liquid crystal adjacent to that segment becomes excited and appears to the viewer to light up. Depending upon the decoder output various numerals appear to be illuminated.

Figure 5:
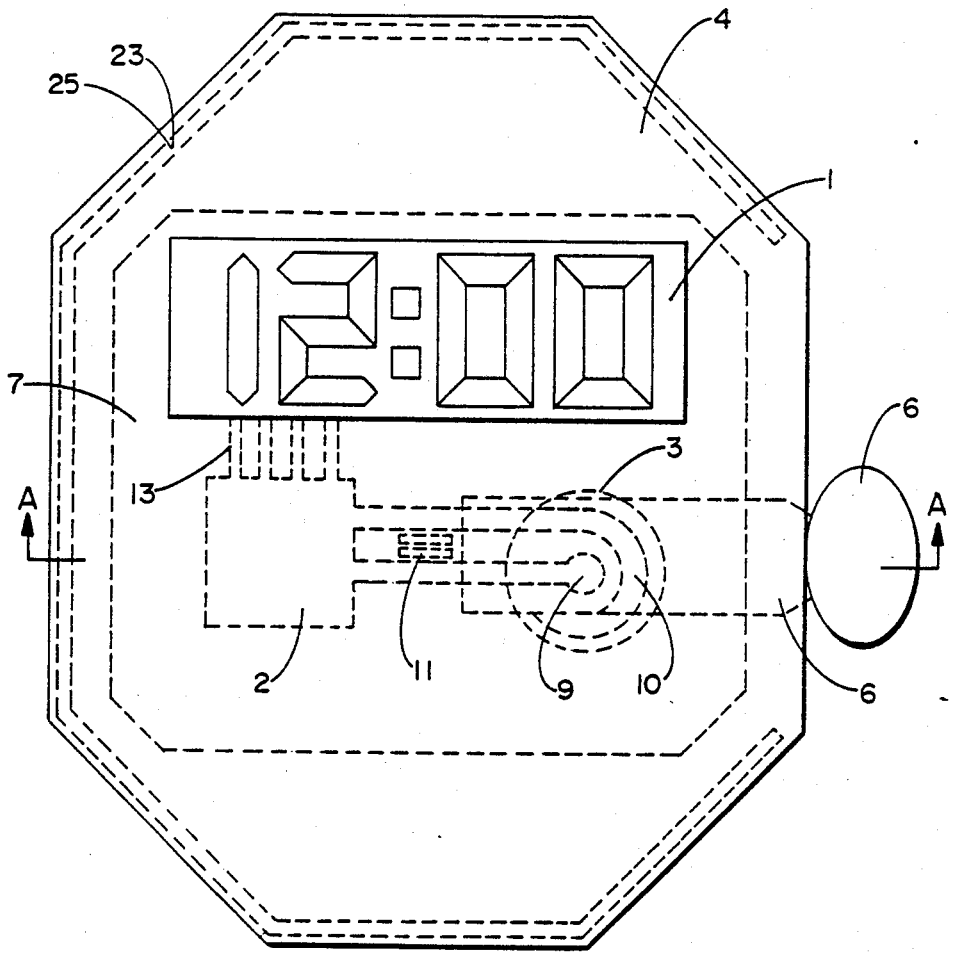
FIG. 5 is an upper plan view of the watch of FIG. 1.

The electronic chip 2 and the LCD 1 are fastened to a wafer substrate 7. The wafer substrate 7 is made of non-conducting material but has etched onto and through it conducting lines 13 which are the electronic paths feeding the outputs from the electronic chip 2 to the LCD 1. The LCD 1 is positioned on the top side 21 of the wafer substrate 7 and the electronic chip 2 is positioned on the bottom side 22. Also etched through and onto the bottom side 22 of the wafer substrate 7 are the power leads 9 and 10 as well as the watch adjuster circuit 11 all of which are shown in FIG. 5.

The power leads 9 and 10 provide the power needed by the electronic chip 2 and the LCD 1. The battery 3 is designed so that the positive and negative returns can be made from the same side. The power leads 9 and 10 are designed and positioned to accomodate this.

The watch adjuster circuit 11 is used to reset the watch to a predetermined time. The watch adjuster circuit 11 is activated by externally inserting through the adjustment hole 12 a metallic pin or similar conductive device. This causes a short circuit in the watch returning the electronic chip 2 to a predetermined time.

Figure 2:
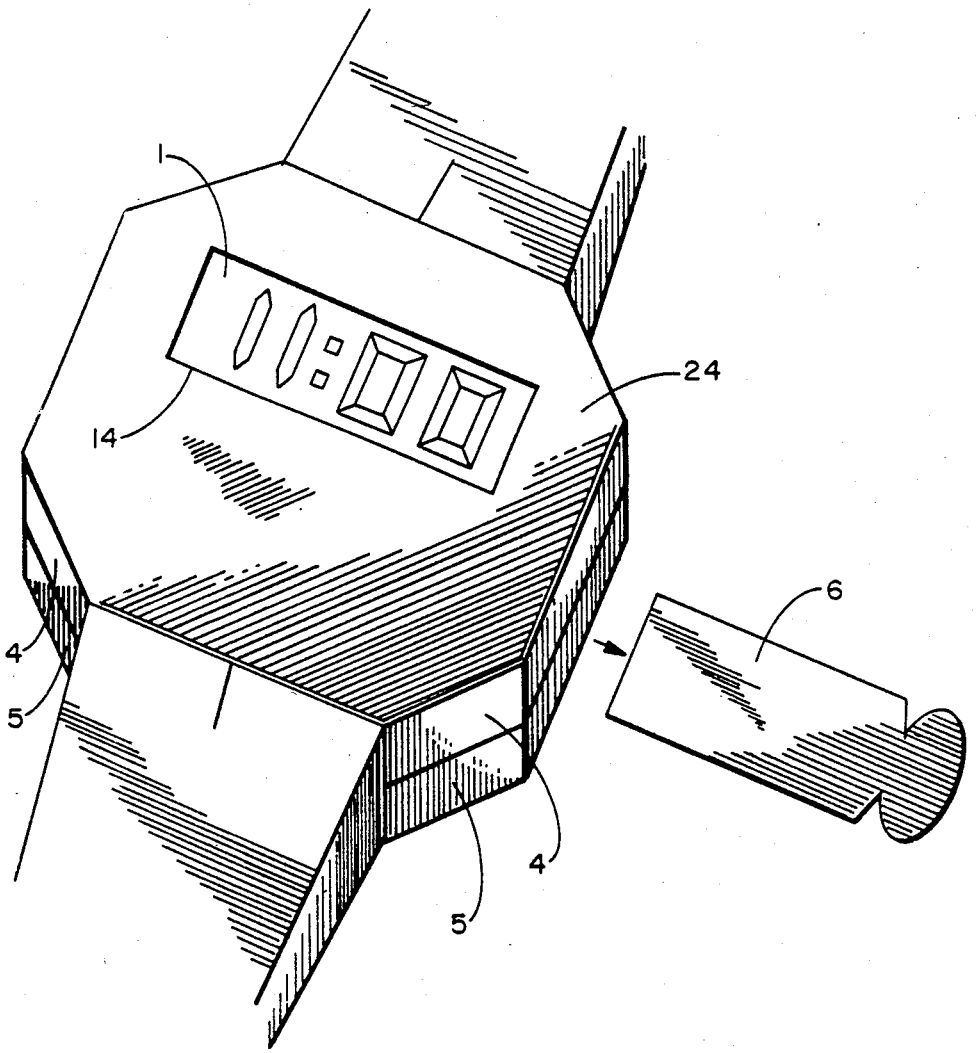
FIG. 2 is a perspective view of the watch of FIG. 1 with the insulating pull tab removed from the watch.

The watch includes within it a battery 3. The battery 3 has a top side 19 and a bottom side 20. The bottom 20 of the battery 3 rests in a cavity 17 in the lower case section 5 of the watch. In the bottom 18 of the cavity 17 are tiny spike shaped cones 8. These cones 8 provide an upward force to the bottom 20 of the battery 3 so that the battery 3 is pushed against the wafer substrate 7 but are not structurely so rigid as to distort the battery 3 or wafer substrate 7 during assembly. The battery 3 is so designed that its positive and negative leads are on the top side 19. The battery 3 is so positioned that the top side 19 with the electrical leads is facing the bottom side 22 of the wafer substrate 7 and aligned with the power leads 9 and 10. However, prior to watch activation, the battery 3 is electrically isolated from the power leads 9 and 10. by means of an insulated pull tab 6. When the pull tab 6 is pulled out from the watch as shown in FIG. 2, the battery 3 touches the power leads 9 and 10 thereby completing an electrical connection and providing power to the watch. The cones 8 shown in FIGS. 3 and FIG. 4 provide the necessary upward force on the battery 3 to insure a good electrical connection.

While the invention has been described in detail with reference to a preferred embodiment thereof, it will be apparent to those skilled in the art that various changes in details may be made therein. It is intended that such modifications be covered within the spirit and scope of the claims appended hereto.

We claim:

1. A disposable electronic watch comprising:

a case with a plurality of sides and having an upper section with an opening at the top and a lower section containing a plurality of cavities;

a wafer substrate of non-conducting material sandwiched between the said upper and lower sections of said case and having a top side and a bottom side;

a display unit attached to the top side of said wafer substrate and positioned at the said opening of the said upper section of the said case;

an electronic circuit chip for providing timing signals to the said display unit attached to the said bottom side of the said wafer substrate and fitting into one said cavity in the said lower section of the said case;

a battery unit with a top side and a bottom side, seated in one said cavity of the said lower section of the said case and having its said top side positioned against the said bottom side of the said wafer substrate;

a plurality of electrical leads on and through the said wafer substrate operatively connecting said display unit, said elctronic chip and said battery unit; and a means for blocking activation of said battery prior to operation of said watch.

2. A disposable electronic watch in accordance with claim 1 wherein:

the display unit is a light emmitting diode (LED).

3. A disposable electronic watch in accordance with claim 1 wherein:

the display unit is a liquid crystal display (LCD).

4. A disposable electronic watch in accordance with claim 3 further comprising:

a time adjustment means on the said wafer substrate.

5. A disposable electronic watch in accordance with claim 4 wherein:

the said case is made of a polymer resin.

6. A disposable electronic watch in accordance with claim 5 wherein:

the means for blocking activation of said battery prior to operation of said watch is a flat, insulated, removeable insert positioned between the top of the said battery and the bottom side of the said wafer substrate, and having two ends, one end of which protrudes outside of the said case.

7. A disposable electronic watch in accordance with claim 6 wherein the said removable insert is plastic.

* * * * *